United States Patent [19]

Eckert et al.

[11] 4,374,872

[45] Feb. 22, 1983

[54] CASEIN COATINGS FOR LEATHER INSOLUBILIZED WITH ALKOXY ALKYL UREAS

[75] Inventors: Guenter Eckert, Limburgerhof; Lothar Wuertele, Ludwigshafen; Harro Petersen, Frankenthal; Ulrich Goeckel; Kurt Fischer, both of Ludwigshafen, all of Fed. Rep. of Germany

[73] Assignee: BASF Aktiengesellschaft, Ludwigshafen, Fed. Rep. of Germany

[21] Appl. No.: 281,489

[22] Filed: Jul. 8, 1981

[30] Foreign Application Priority Data

Jul. 16, 1980 [DE] Fed. Rep. of Germany ..... 3026863

[51] Int. Cl.[3] ..... B05D 3/04

[52] U.S. Cl. ..... 427/338; 8/94.1 R; 8/94.21; 8/127.6; 427/340; 427/370; 427/379; 427/389; 427/414; 428/473

[58] Field of Search ..... 427/389, 338, 340, 341, 427/369, 414, 370, 379; 428/473; 8/94.1 R, 94.21, 127.6

[56] References Cited

U.S. PATENT DOCUMENTS

| | | | |
|---|---|---|---|
| 2,003,065 | 6/1931 | Boyce | 427/414 X |
| 3,078,185 | 2/1963 | Kine et al. | 427/389 X |
| 3,987,223 | 10/1976 | Wagner et al. | 427/389 |

FOREIGN PATENT DOCUMENTS

| | | |
|---|---|---|
| 271085 | 1/1951 | Switzerland . |

*Primary Examiner*—Thurman K. Page
*Attorney, Agent, or Firm*—Bernhard R. Swick

[57] ABSTRACT

A process is disclosed for insolubilizing casein coatings for leather utilizing alkoxy alkyl ureas. The coatings are cured in the presence of an acid catalyst. The casein coatings of the invention avoid the disadvantageous use of aldehydes such as formaldehyde and glutaraldehyde to cure the casein and reduce its water sensitivity and unexpectedly show improved wet abrasion resistance.

6 Claims, No Drawings

CASEIN COATINGS FOR LEATHER INSOLUBILIZED WITH ALKOXY ALKYL UREAS

BACKGROUND OF THE INVENTION

1. Field of the Invention

This invention relates to casein coatings for leather applied as aqueous systems.

2. Description of the Prior Art

Leather finishes have employed casein to improve the "hand" of the leather as well as optical properties, such as color and gloss. Grained leather, in particular, requires the application of a surface finish coating to provide gloss. Generally, aqueous systems are utilized to apply the casein finish to the leather. Without further treatment, casein coatings remain sensitive to water, tending to dissolve or swell when exposed to water. Generally, casein coatings for leather have been cross-linked or cured so as to reduce the water sensitivity of the coating. Formaldehyde or glutaraldehyde has been used in the prior art to cross-link or cure the casein. Alternatively, melamine ethers have been used to cure the casein.

The drawbacks of the utilization of formaldehyde to cure casein coatings for leather are well known. Because of the high volatility of formaldehyde, its use as a cross-linking or curing agent for casein is disadvantageous from a toxicological standpoint. The use of glutaraldehyde as a cross-linking or curing agent is also disadvantageous since glutaraldehyde cross-linked casein finishes for leather tend to discolor with age. A representative prior art process for finishing leather with casein is disclosed in Swiss Pat. No. 271,085.

It is therefore an object of this invention to provide a process for finishing leather utilizing casein which avoids the disadvantages of formaldehyde or glutaraldehyde as cross-linking agents to reduce the water sensitivity of the casein coating.

SUMMARY OF THE INVENTION

It has been found that alkoxy alkyl urea will insolubilize casein coatings for leather by reaction therewith in the presence of an acid catalyst. The insolubilization reaction is a cross-linking or curing reaction which takes place at ambient temperatures over a period of several days but can be accelerated by heating at elevated temperatures up to 160° C. Unexpectedly, the process of the invention provides casein coated leather having improved wet abrasion strength.

DETAILED DESCRIPTION OF THE PREFERRED EMBODIMENT

The alkoxy alkyl ureas useful in the process of the invention can be mono-, di-, or trialkoxy alkyl ureas. Preferably, di(methoxy methyl) urea or di(ethoxy methyl) urea are utilized. The manufacture of these compounds is known in the prior art. A representative process for the manufacture of di(methoxy methyl) urea is as follows:

Into a four-liter flask equipped with an agitator, cooler, and thermometer, there are mixed urea and formaldehyde in a mole ratio of 1:4. Initially, there are added a total weight mixture of 50 parts of formaldehyde and 25 parts of urea. Thereafter, 4 parts by weight of potassium carbonate and 250 parts by weight of urea are added to the flask. The pH of the mixture is 9.5 to 9.6. The mixture is slowly heated to a temperature of 50° C. and mixed at this temperature for 2 hours. Thereafter, 800 parts by weight of methanol are introduced into the viscous solution containing approximately 2 percent by weight of free formaldehyde. The pH of the mixture is then adjusted to 1.0 to 1.1 by the addition of 36 parts by weight of 75 percent by weight sulfuric acid and the mixture is thereafter stirred at 50° C. for 3 hours. The clear solution obtained is then cooled to 25° to 30° C., adjusted to a pH of 8.5 with 50 percent by weight sodium hydroxide solution and the precipitate which is formed is filtered off. The excess methanol is removed from the filtrate at approximately 40° C. at a pressure of 25 millibars. The residue obtained in the amount of 1280 parts by weight is a colorless, viscous liquid having a solids content of 71 percent by weight and a free-formaldehyde content of approximately 0.6 to 0.8 percent by weight. For further use, the mixture is adjusted to 60 percent by weight solids by the addition of 234 parts by weight of water.

Suitable acids for the catalysis of the reaction of casein and alkoxy alkyl urea are various commercially available organic and inorganic acids such as sulfuric acid, oxalic acid, glycolic acid, para-toluene sulfonic acid, formic acid, acetic acid, propionic acid, amidosulfonic acid, citric acid, tartaric acid, boric acid, and phthalic acid. Preferably, sulfuric acid and oxalic acid are utilized as catalysts for the reaction. These acids are used as aqueous solutions, generally 1 to 10 percent by weight aqueous solutions, preferably 2 to 10 percent by weight, and most preferably 2.5 to 5 percent by weight aqueous solutions.

The following examples illustrate the various aspects of the invention but are not intended to limit its scope. Where not otherwise specified throughout this specification and claims, temperatures are given in degrees centigrade and parts, percentages and proportions are by weight.

EXAMPLE 1

A vegetable tanned goat leather was glaze-trimmed in accordance with the following procedure. The leather was spray dyed utilizing a mixture of 200 parts by weight of a commercially-available liquid 1:2-metal complex dye, 100 parts by weight of ethylene glycol monoethylether, and 700 parts of water. The sample of vegetable tanned goat leather was sprayed followed by drying. Subsequently, the spraydyed leather was finished by coating in accordance with the process of this invention utilizing a mixture of 300 parts by weight of a commercially-available 12 percent by weight aqueous casein solution, 650 parts by weight of water, 50 parts by weight of a 60 percent aqueous solution of di- (methoxy methyl) urea produced in accordance with the procedure above. The leather was finished by spraying with the above solution utilizing two successive spraying and drying cycles. Subsequently, two applications of a 5 percent by weight aqueous sulfuric acid solution were utilized to cross-link the coating. The sample was dried, glazed and then pressed at 100° C. at 50 bars pressure. Evaluation of the coated leather in accordance with the IUF 450 test method for wet abrasion resistance indicated the sample was capable of withstanding up to 400 abrasion cycles.

EXAMPLE 2

(Comparative Example forming no part of this invention)

The vegetable tanned goat leather of Example 1 was spray dyed and finished utilizing a solution of 300 parts by weight of a commercially-available 12 percent by weight casein solution and 700 parts by weight of water. The coating was applied by two successive spraying and drying cycles. There was then applied in a single spraying process a 33 percent by weight aqueous formaldehyde solution to cure the casein coated sample. The sample was dried, glazed, and subsequently pressed as in Example 1. Evaluation of the coated leather for wet abrasion resistance utilizing the IUF 450 test method showed the sample resistant to only 40 abrasion cycles.

EXAMPLE 3

A sample of calf leather was glaze-trimmed in accordance with the following procedure:

A base coating was applied utilizing a mixture of 300 parts by weight of a commercially-available 12 percent by weight aqueous casein solution, 50 parts by weight of a commercially-available aqueous pigment preparation, 600 parts by weight of water, and 50 parts by weight of a 60 percent by weight aqueous solution of di(ethoxy methyl) urea produced in accordance with the procedure described above by substituting 1150 parts by weight of ethanol for the methanol utilized in the procedure above. The above mixture was applied as a coating in two successive spraying and drying cycles.

Thereafter, the base-coated calf leather was finished in accordance with the process of the invention utilizing a mixture of 300 parts by weight of a 12 percent by weight casein solution, 650 parts by weight of water, and 50 parts by weight of a 60 percent by weight aqueous solution of di(ethoxy methyl) urea. The coating was applied by two successive spraying and drying cycles. Thereafter, two applications of a 5 percent by weight aqueous sulfuric acid solution were applied to the coated leather to cure or cross-link the casein di(ethoxy methyl) urea reaction product. The sample was dryed, glazed, and pressed at 100° C. and 50 bars pressure. Evaluation of the coated leather for wet abrasion in accordance with the IUF 450 test method resulted in a determination that the sample was capable of withstanding 400 abrasion cycles.

EXAMPLE 4

(Comparative Example forming no part of this invention)

Using the base-coated calf leather of Example 3, a finish coating was applied utilizing a mixture of 300 parts by weight of a 12 percent by weight casein solution and 700 parts by weight of water. The coating was applied in two successive spraying and drying cycles. Thereafter, the coating was cross-linked by exposure to a 33 percent by weight aqueous formaldehyde solution. Subsequently, the coating was dried, glazed, and pressed at 100° C. at a pressure of 50 bars. Evaluation of the coated leather for wet abrasion in accordance with the IUF 450 test method resulted in a determination that the sample was capable of withstanding only 50 abrasion cycles.

EXAMPLE 5

A plated finish on heavy cowhide was spray dyed utilizing 200 parts by weight of a commercially-available liquid 1:2-metal complex dye, 100 parts by weight of ethylene glycol monoethylether, and 700 parts by weight of water. The dye was applied by spraying followed by drying. Thereafter, a base coat was applied to the leather using a mixture of 100 parts by weight of a commercially-available 40 percent by weight solids acrylate dispersion, 200 parts by weight of a 12 percent by weight aqueous casein solution, 50 parts by weight of a commercially-available aqueous pigment preparation, 615 parts by weight of water, and 35 parts by weight of the 60 percent by weight aqueous di(methoxy methyl) urea solution used in Example 1. The base coat was applied by three successive spraying, drying, and pressing cycles at a temperature of 80° C. and a pressure of 50 bars. Thereafter, a finish coat was applied in accordance with a process of the invention utilizing a mixture of 300 parts by weight of a commercially-available 12 percent by weight casein solution, 650 parts by weight of water, and 50 parts by weight of a 60 percent by weight aqueous mono(ethoxy methyl) urea solution. This finish coating was applied by two successive spraying, drying cycles followed by two successive applications of a 10 percent by weight aqueous oxalic acid solution followed by drying and pressing at 150° C. and 50 bars pressure. Evaluation of the coated leather for wet abrasion resistance in accordance with the IUF 450 test method indicated that the sample was capable of withstanding 600 abrasion cycles.

EXAMPLE 6

(Comparative Example forming no part of this invention)

Utilizing the spray-dyed and base-coated heavy cowhide leather of Example 5, there was applied a finish coating from a mixture of 100 parts by weight of a 12 percent by weight casein solution and 700 parts by weight of water. This finish coat was applied by two successive spraying, and drying cycles followed by a cross-linking treatment with a 33 percent by weight aqueous formaldehyde solution and subsequent drying and pressing at 150° C. and 50 bars pressure. Evaluation of the coated leather for wet abrasion resistance utilizing the IUF 450 test method indicated the sample was capable of withstanding only 30 abrasion cycles.

While this invention has been described with reference to certain specific embodiments, it will be recognized by those skilled in the art that many variations are possible without departing from the scope and spirit of the invention and it will be understood that it is intended to cover all changes and modification of the invention disclosed herein for the purposes of illustration which do not constitute departures from the spirit and scope of the invention.

The embodiments of the invention in which an exclusive privilege or property is claimed are defined as follows:

1. A process for finishing leather and improving the wet abrasion resistance thereof comprising:

(A) applying a coating to said leather with an aqueous coating composition consisting essentially of a mixture of casein and an alkoxy alkyl urea, (B) thereafter drying said coating and applying an acid catalyst thereto, and thereafter (C) drying, pressing, and curing said coating at ambient temperature to about 160° C.

2. The process of claim 1 wherein said alkoxy alkyl urea is at least one of a mono-, di-, or trialkoxy alkyl urea and said acid catalyst is applied as an aqueous solution of an organic or inorganic acid.

3. The process of claim 2 wherein said alkoxy alkyl urea is selected from at least one of the group consisting of di(methoxy methyl) urea and di(ethoxy methyl) urea.

4. The process of claim 3 wherein said acid catalyst is an aqueous solution of an acid selected from at least one of the group consisting of sullfuric acid, oxalic acid, glycolic acid, para-toluene sulfonic acid, formic acid, acetic acid, propionic acid, amidosulfonic acid, citric acid, tartaric acid, boric acid, and phthalic acid.

5. The process of claim 3 wherein said acid catalyst is sulfuric acid and said alkoxy alkyl urea is di(methoxy methyl) urea.

6. The process of claim 3 wherein said acid catalyst is oxalic acid and said alkoxy alkyl urea is mono(ethoxy methyl) urea.

* * * * *